US006186909B1

(12) United States Patent
Swanson, Jr.

(10) Patent No.: US 6,186,909 B1
(45) Date of Patent: Feb. 13, 2001

(54) BUNT GUARD

(76) Inventor: Paul Kenneth Swanson, Jr., 3001 E. Reno, Broken Arrow, OK (US) 74014

( * ) Notice: Under 35 U.S.C. 154(b), the term of this patent shall be extended for 0 days.

(21) Appl. No.: 09/295,040

(22) Filed: Apr. 20, 1999

(51) Int. Cl.[7] ..... A63B 69/00

(52) U.S. Cl. ..... 473/422; 473/457; 473/201; 446/473

(58) Field of Search ..... 473/415, 46, 422, 473/451, 457, 458, 465, 468, 499, 437, 201, FOR 102, FOR 103, FOR 105; 446/473

(56) References Cited

U.S. PATENT DOCUMENTS

D. 258,343 * 2/1981 Beck .
D. 334,085 3/1993 Niemann .
3,834,249 * 9/1974 Bothwell .
3,944,226 * 3/1976 Starrett .
4,080,751 * 3/1978 Copstead .
4,214,751 * 7/1980 Simpson .
4,365,416 12/1982 Overbury .
4,423,868 * 1/1984 Younts .
4,670,932 * 6/1987 Williams .
4,750,760 * 6/1988 Gurley .
5,127,871 * 7/1992 Miller .
5,256,099 * 10/1993 Rudell .
5,447,308 * 9/1995 Girard .

* cited by examiner

*Primary Examiner*—Benjamin H. Layno
*Assistant Examiner*—Vishu Mendiratta
(74) *Attorney, Agent, or Firm*—Molly D. McKay

(57) ABSTRACT

A bunt guard (10) removably attachable to a baseball bat (12) for protecting a player's fingers and hand from impact by a baseball while the player is learning to bunt a baseball. A ring (14) on the bunt guard encircles the baseball bat and removably secures the bunt guard to a tapered portion of the bat by a frictional fit. A shield (16) attaches to the ring (14) and extends on the front side (28) of the bat (12) where the player grips the baseball bat (12) when bunting. The shield (16) protects the player's fingers and hand from impact with a baseball.

4 Claims, 3 Drawing Sheets

BUNT GUARD

BACKGROUND OF THE INVENTION

1. Field of the Invention

The present invention relates to a guard for use in association with a baseball or softball bat as a means to teach a batter to safely bunt a baseball or softball. This guard is for use in practice only and is not to be used in actual ball games. The bunt guard attaches to the tapered portion of the bat via friction fit. The bunt guard is provided with a shield that is held in spaced apart relationship with the bat so that a batter's hand can insert behind the shield when the batter is holding a baseball bat properly in preparation to bunt a baseball.

2. Description of the Related Art

To properly bunt a baseball, a baseball player must grip the handle of a baseball bat with his "off" hand and grip the bat approximately ⅔ of the way up the bat with his "on" hand. The "on" hand is the right hand for a right handed batter who is batting right handed, or alternately, is the left hand for a left handed batter who is batting left handed. If the "on" hand is not properly placed on the bat with the hand behind the bat and pinching the sides of the bat, fingers and hand of the player's "on" hand can be struck by a baseball as the batter attempts to bunt the baseball.

Many baseball players never learn how to bunt a baseball properly because of their fear of having their fingers and hand hit by the baseball or smashed between the baseball and the baseball bat when they attempt to bunt. The player's fear prevents the player from learning the proper finger placement of his "on" hand onto the bat that would help to avoid such injury. Also, even if a new player is not afraid of being injured, often he will be injured before he learns the proper way to grip the bat when he tries to bunt.

Other devices have been employed to assist in training a player to bunt. However, none of the prior devices attach to the player's regular baseball bat and allow the player to move his hands from the normal batting grip to the proper position on the bat for bunting. Also, none of the other prior devices do this while providing adequate protection to the players hand to prevent injury from the baseball while the player is learning to bunt.

SUMMARY OF THE INVENTION

The present invention is a bunt guard that attaches to a regular baseball bat. The bunt guard is provided with a ring that slides over the handle of the bat and is pushed toward the opposite end of the bat until the ring tightly engages the tapered portion of the bat. This causes the bunt guard to be secured to the bat by a friction fit. The ring is properly sized so that it positions the bunt guard over the proper location on the baseball bat for the player to place his "on" hand when practicing bunting.

A shield secures to the ring so that the shield is positioned in spaced-apart relationship with the bat and is located on the front side of the bat. The front side of the bat is the side of the bat from which the baseball is pitched and also the side of the bat that will encounter the baseball when the baseball is bunted. The shield of the bunt guard is sufficiently large that the player may slide his hand behind the shield to properly position his hand to bunt. In this position, the shield protects the player's hand from being impacted with the baseball when he is bunting.

The bunt guard may be loosened from the bat by pushing the bunt guard toward the handle of the bat. This frees the frictional hold that the bunt guard has on the bat and the bunt guard may be removed from the bat by passing the ring over the handle of the bat.

DETAILED DESCRIPTION OF THE PREFERRED EMBODIMENT INVENTION

Figure 2:
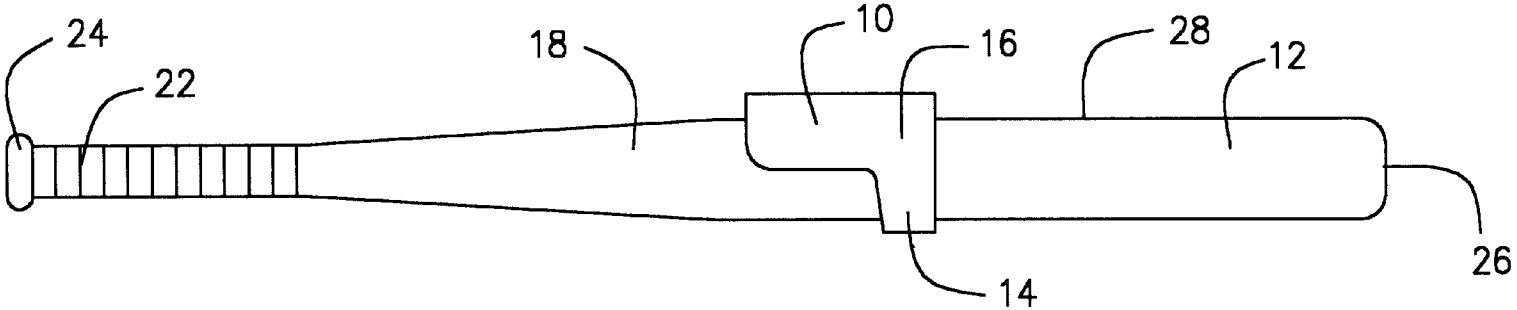
FIG. 2 is a right side elevation of the bunt guard and baseball bat of FIG. 1.
Figure 1:
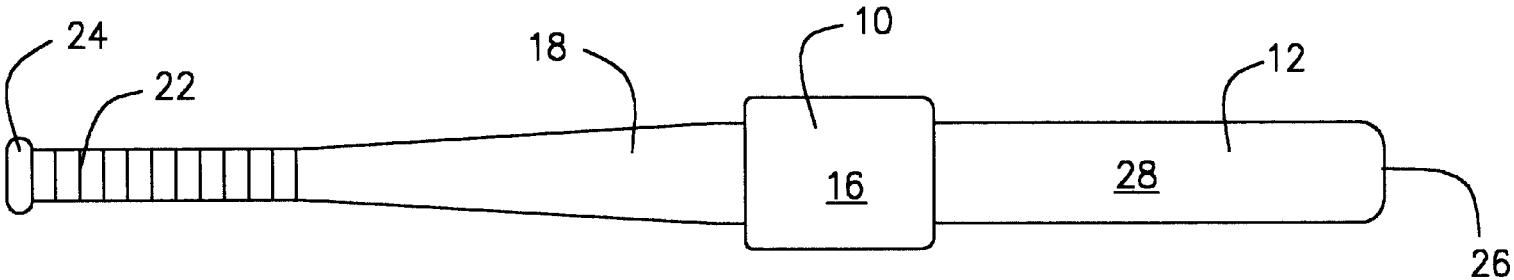
FIG. 1 is a front elevation of a bunt guard that is constructed in accordance with a preferred embodiment of the present invention. The bunt guard is shown secured to a baseball bat.

Referring now to the drawings and initially to FIGS. 1 and 2, there is illustrated a bunt guard 10, constructed in accordance with a preferred embodiment of the present invention. The bunt guard 10 is shown removably attached to a baseball bat 12. Although the bunt guard 10 is described in association with a baseball bat 12, its use is not limited to a baseball bat, but may be used in association with a softball bat or other suitable bat means.

Figure 3:
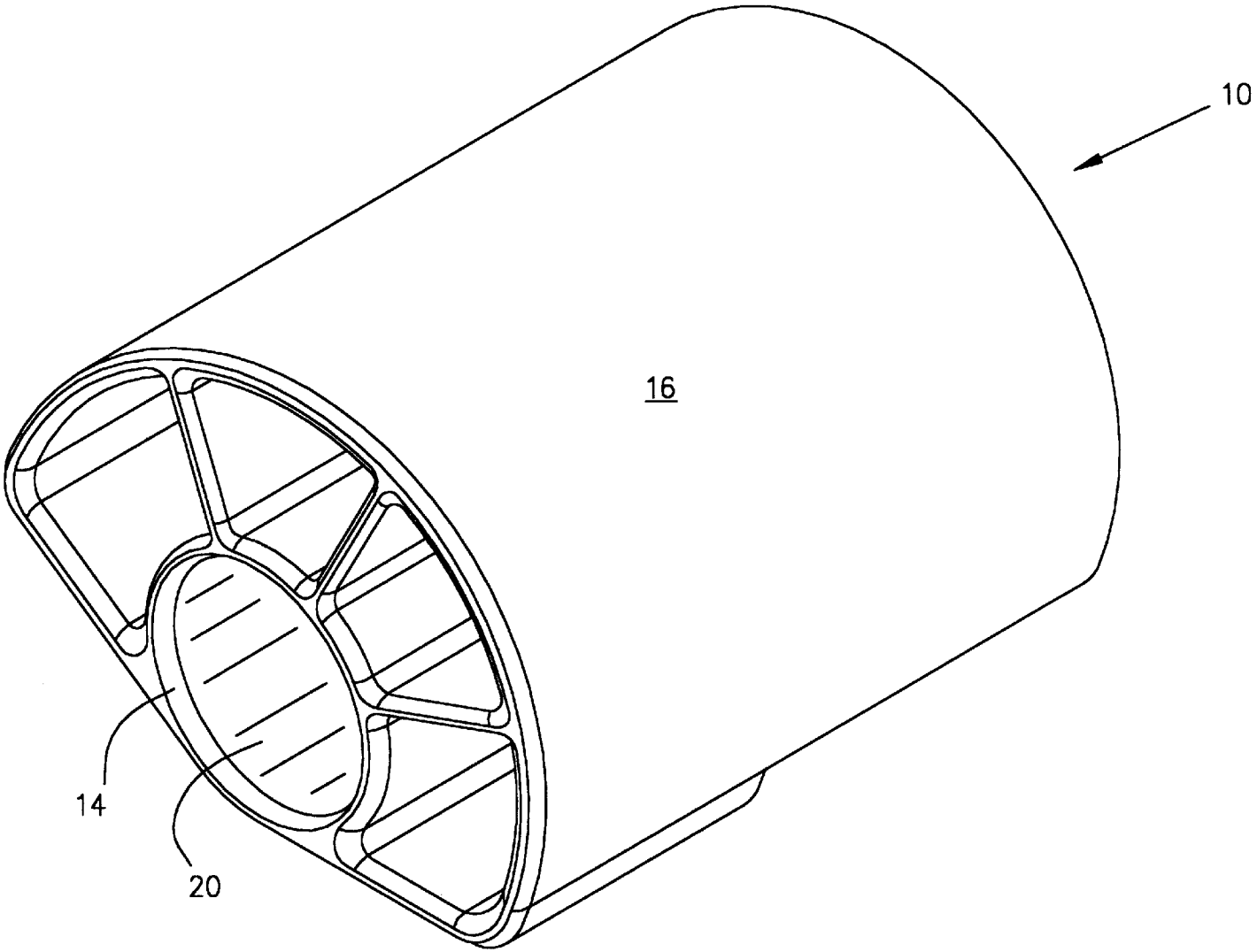
FIG. 3 is a front perspective view of the bunt guard of FIGS. 1 and 2, as it would appear detached from a baseball bat.
Figure 4:
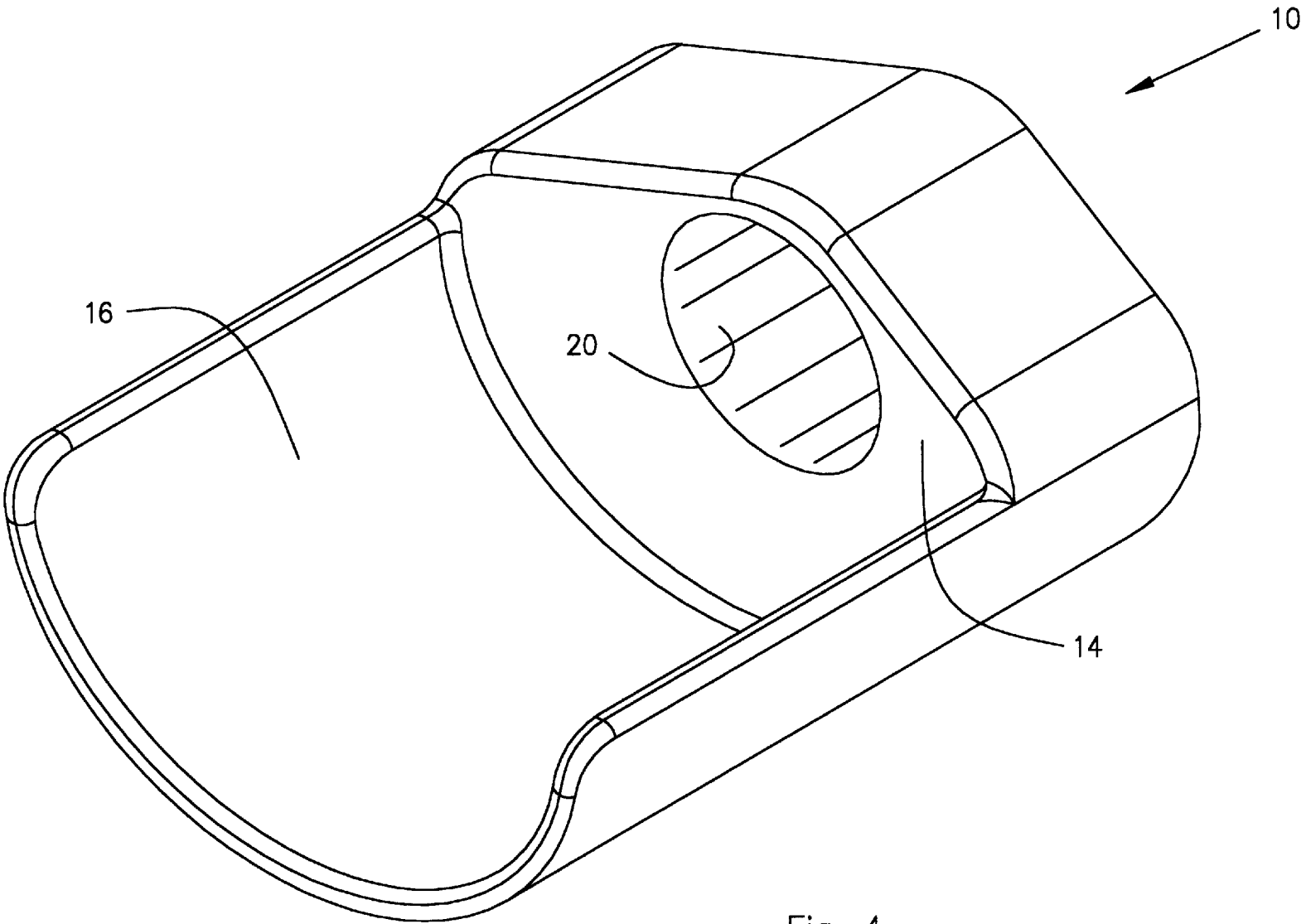
FIG. 4 is a rear perspective view of the bunt guard of FIG. 3.

Referring also to FIGS. 3 and 4, the bunt guard 10 is comprised of a ring 14 and a shield 16 that attaches to the ring 14. When the bunt guard is secured to the baseball bat 12, the ring 14 encircles the baseball bat and the ring 14 is wedged via a friction fit onto a tapered portion 18 of the baseball bat 12. The ring 14 is provided with a central opening 20 extending longitudinally through the ring 14.

To attach the bunt guard 10 to the baseball bat 12, the ring 14 of the bunt guard 10 slides over a handle 22 on a first end 24 of the baseball bat 12 so that the baseball bat 12 enters the central opening 20. The bunt guard 10 is then pushed toward an opposite second end 26 of the baseball bat 12, until the ring 14 tightly engages the tapered portion 18 of the baseball bat 12, causing the bunt guard 10 to be secured to the baseball bat 12 by a friction fit.

The ring 14 is properly sized so that it positions the bunt guard 10 over the proper location on the tapered portion 18 of the baseball bat 12 for the player (not illustrated) to place his "on" hand when bunting. The shield 16 secures to the ring 14 so that the shield 16 is positioned in spaced-apart relationship with the baseball bat 12 and is located on a front side 28 of the baseball bat 12. The front side 28 of the baseball bat 12 is the side of the baseball bat 12 from which a baseball is pitched and also the side of the baseball bat 12 that will encounter the baseball when the baseball is bunted. The shield 16 of the bunt guard 10 is sufficiently large that a player may slide his hand behind the shield 16 to properly position his hand when bunting. With the player gripping the baseball bat 12 in this bunting position, the shield 16 protects the players hand from being impacted with the baseball when he is bunting.

The bunt guard 10 may be loosened from the baseball bat 12 by pushing the bunt guard 10 toward the first end 24 or the handle 22 of the baseball bat 12. This moves the ring 14 toward a smaller diameter area on the tapered portion 18 and frees the frictional hold that the bunt guard 10 had on the baseball bat 12. Once thus loosened from the baseball bat 12, the bunt guard 10 may be removed from the baseball bat 12 by passing the ring 14 over the handle 22 of the baseball bat 12.

Although the bunt guard may be constructed from any suitable material, in one preferred embodiment, the ring 14 and the shield 16 are molded in one piece from polycarbonate.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A bunt guard removably attachable to a ball bat for protecting a player's fingers and hand from injury by a ball when the player is bunting consisting of:

a ring removably engagable with a tapered portion of a ball bat, and a rigid shield secured to only one side of said ring and extending toward the handle end of the ball bat, the shield cantilevered over the ball bat toward the handle of the ball bat so that said shield extends over a portion of the ball bat that is gripped by a player when bunting a ball.

2. A bunt guard according to claim 1 wherein said ring and said shield are made of polycarbonate.

3. A bunt guard removably attachable to a ball bat for protecting a player's fingers and hand from injury by a ball when the player is bunting consisting of:

a ring removably secured by frictional fit to a tapered portion of a ball bat, a rigid shield attached to only one side of said ring, said shield extending from said ring toward the handle of the bat and cantilevered over the ball bat toward the handle end of the ball bat, and said ring being provided with a central opening of a diameter so that the ring secures the shield over a portion of the ball bat that is gripped by a player when the player is bunting a ball.

4. A bunt guard according to claim 3 wherein said ring and said shield are made of polycarbonate.

* * * * *